US009403665B2

(12) United States Patent
Herse

(10) Patent No.: US 9,403,665 B2
(45) Date of Patent: Aug. 2, 2016

(54) ROTATING TOWER CRANE

(75) Inventor: Thomas Herse, Biberach (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 333 days.

(21) Appl. No.: 14/116,691

(22) PCT Filed: May 10, 2012

(86) PCT No.: PCT/EP2012/002029

§ 371 (c)(1), (2), (4) Date: Nov. 8, 2013

(87) PCT Pub. No.: WO2012/152446

PCT Pub. Date: Nov. 15, 2012

(65) Prior Publication Data

US 2014/0076835 A1 Mar. 20, 2014

(30) Foreign Application Priority Data

May 10, 2011 (DE) ..... 20 2011 100 477 U

(51) Int. Cl.

| | |
|---|---|
| ***B66C 23/02*** | (2006.01) |
| ***B66C 23/20*** | (2006.01) |
| ***B66C 23/28*** | (2006.01) |
| ***B66C 23/18*** | (2006.01) |
| ***B66C 23/60*** | (2006.01) |

(52) U.S. Cl.

CPC ..... *B66C 23/208* (2013.01); *B66C 23/185* (2013.01); *B66C 23/207* (2013.01); *B66C 23/283* (2013.01); *B66C 23/60* (2013.01)

(58) Field of Classification Search

CPC ..... B66C 21/06; B66C 23/02; B66C 23/022; B66C 23/025; B66C 23/16; B66C 23/20; B66C 23/203; B66C 23/207; B66C 23/228; B66C 23/62; B66C 23/283

See application file for complete search history.

(56) References Cited

U.S. PATENT DOCUMENTS

| | | | | | |
|---|---|---|---|---|---|
| 3,153,486 | A | * | 10/1964 | Strnad | B66C 23/18 212/176 |
| 3,335,876 | A | * | 8/1967 | Durand | B66C 23/18 212/295 |
| 3,366,251 | A | | 1/1968 | Strnad | |
| 5,146,096 | A | * | 9/1992 | McConachy | F03D 1/00 290/44 |
| 5,247,776 | A | * | 9/1993 | Tamayo | E21B 15/00 52/111 |
| 5,259,479 | A | * | 11/1993 | St-Germain | E04G 1/20 182/146 |

(Continued)

FOREIGN PATENT DOCUMENTS

| | | | |
|---|---|---|---|
| CN | 2133563 | Y | 5/1993 |
| CN | 101979308 | A | 2/2011 |

(Continued)

OTHER PUBLICATIONS

Chinese Office Action dated Aug. 5, 2014, with English translation (fourteen (14) pages).

(Continued)

*Primary Examiner* — Emmanuel M Marcelo

(74) *Attorney, Agent, or Firm* — Crowell & Moring LLP

(57) ABSTRACT

The present invention relates to a tower crane with a tower of at least one tower element, in particular lattice piece, and a structural guying with at least one guy rod for the horizontal anchorage of the tower at a structure, wherein the at least one guy rod of the structural guying is attached or attachable to an attachment point of the tower element.

13 Claims, 4 Drawing Sheets

(56) References Cited

U.S. PATENT DOCUMENTS

Figure 1:
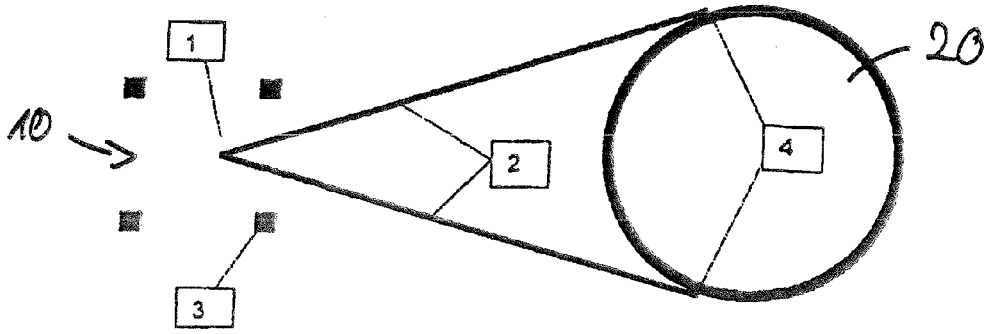

| | | | | |
|---|---|---|---|---|
| 5,537,125 | A * | 7/1996 | Harrell, Jr. | H01Q 1/1235 248/188.5 |
| 5,658,201 | A * | 8/1997 | Kleimeyer | A63G 27/00 472/27 |
| 2011/0016804 | A1* | 1/2011 | Howard | E04H 12/20 52/146 |
| 2011/0283640 | A1* | 11/2011 | Miller | E02D 27/42 52/292 |
| 2013/0164134 | A1* | 6/2013 | Goldstein | F03D 11/04 416/140 |

FOREIGN PATENT DOCUMENTS

| | | | |
|---|---|---|---|
| DE | 200 18 890 | U1 | 1/2002 |
| FR | 2 803 865 | A1 | 7/2001 |
| FR | 2 943 743 | A1 | 10/2010 |
| JP | 8-40690 | A | 2/1996 |
| JP | 10-2108 | A | 1/1998 |
| JP | 2001-199680 | A | 7/2001 |
| JP | 2009-91123 | A | 4/2009 |
| JP | 2010-6481 | A | 1/2010 |

OTHER PUBLICATIONS

International Search Report (PCT/ISA/210) with partial English translation dated Sep. 8, 2012 (Eight (8) pages).

German Search Report with partial English translation dated Mar. 7, 2012 (Ten (10) pages).

International Written Opinion (PCT/ISA/237) dated Sep. 8, 2012 (Six (6) pages).

* cited by examiner

ROTATING TOWER CRANE

The present invention relates to a tower crane with a tower of at least one tower element, in particular at least one lattice piece and a structural guying with at least one guy rod for the horizontal anchorage of the tower at a structure.

In tower cranes in which the tower consists of one or more tower elements which are connected with each other in vertical direction, the height of the tower can be increased by inserting further tower elements. However, tower cranes have a maximum freestanding hook height. When the same is exceeded, the tower crane must be fixed at the structure to be erected by a horizontal anchorage. The maximum achievable hook height thereby can be increased distinctly.

In particular, it is possible in such tower cranes to have the tower crane grow with the structure by incorporating further tower elements, wherein the stability of the tower crane is ensured by one or more structural guyings.

As structural guying according to the prior art a separately mountable frame is used, which subsequently is mounted around the tower element and then is connected with the structure via guy rods. This solution is known for example from the document U.S. Pat. No. 3,366,251. The assembly of known tower cranes with a structural guying hence is relatively complex and time-consuming.

Therefore, it is the object of the present invention to provide a tower crane with a structural guying which can be mounted more quickly.

According to the invention, this object is solved by a tower crane according to claim 1. The tower crane according to the invention includes a tower comprising at least one tower element, in particular at least one lattice piece, and a structural guying with at least one guy rod for the horizontal anchorage of the tower at a structure. According to the invention it is provided that the at least one guy rod of the structural guying is attached or attachable to an attachment point of the tower element. According to the invention, the use of an enclosing frame to be mounted separately thus is omitted, in that the at least one guy rod is directly connected with the attachment point integrated into the tower element. The assembly effort thereby is reduced considerably. The guy rod need not be an individual rod, but for example can also be designed as truss.

The tower crane according to the present invention in particular can also be used in those structures which only have a short construction time and in particular grow upwards very quickly, so that the expenditure for the horizontal anchorage of the tower crane has a considerable influence on the entire construction time.

In particular, the tower crane according to the invention particularly advantageously can be used in the assembly of wind turbines. The structural guying according to the invention thus allows a particularly economic use of the tower crane, since the at least one attachment point for the structural guying provided directly at the tower element allows a considerably faster support of the tower crane on the mast of the wind turbine. However, the tower crane according to the invention can of course also be used in conventional buildings.

The tower of the tower crane according to the invention advantageously consists of a plurality of tower elements which are put onto each other and connected with each other, in particular bolted to each other, in vertical direction. In particular, the tower elements are lattice pieces.

Such lattice pieces represent a welded construction, wherein usually four corner posts are connected with each other via transverse struts. In their end regions, the corner posts usually have connecting arrangements for connection with the lattice pieces arranged below or above the same. Advantageously, the attachment point for the direct articulation of the guy rod now is firmly connected with the welded construction of the lattice piece, in particular welded to the same.

According to the invention, the attachment point can be provided on a side face or in the interior of the tower element. Different arrangements with one or more attachment points are conceivable.

In a furthermore advantageous way, at least two guy rods can be provided, which connect the tower element with the structure. Advantageously, the two guy rods are attachable to a common attachment point such that they extend to different attachment points with the structure. This provides a force triangle which keeps the attachment point of the tower element in a defined position relative to the structure.

According to the invention, the connection of the guy rod or the guy rods with the attachment points at the structure can be effected via a bolt connection. However, other types of connection are also conceivable.

The connection of the guy rod or guy rods with the at least one attachment point of the tower element likewise can be effected via a bolt connection. However, other types of connection are also conceivable. Furthermore, the guy rod can also be firmly connected with the attachment point.

In a particularly preferred embodiment of the present invention the attachment point can be arranged centrally with respect to a side width of the tower element and/or the base area of the tower element. By such a symmetrical arrangement the swivel moments of the crane, which are transmitted to the structure via the guy rods, are minimized. The load on the structure in the region of the guying point also is reduced thereby. This can likewise lead to a saving of costs on the part of the building.

When the attachment point is provided in the interior of the tower element and/or arranged centrally with respect to the side width or the base area of the tower element, the guying with the structure in the region of the tower element can be effected via two guy rods only. The guy rods then extend from the attachment point in the form of a triangle to attachment points at the structure.

Advantageously, the tower element is a lattice piece, wherein the attachment point is provided by a strut extending in vertical direction, which is arranged in the interior of the lattice piece. In particular, the strut can be a tubular element with circular cross-section.

In particular, such strut extending in vertical direction can be arranged between two struts extending in horizontal direction. The struts extending in horizontal direction either can directly be connected with the corner posts and hence extend diagonally. Advantageously, however, the struts extending in horizontal direction are connected with the corner posts of the lattice piece via horizontal struts extending in the side faces.

In a furthermore advantageous way, the guy rods are rotatably connected with the attachment point about a vertical axis of rotation. In particular, the guy rods can enclose the vertical strut described above in detail and be pivotally mounted around the same. As a result no more swivel moments of the crane at all are transmitted to the structural guying.

The guy rods can have a multipart design, so that an element forming the joint is firmly arranged at the tower element, and a second element making the connection to the structure is releasably connectable with the same. Advantageously, the connection of the two elements is effected in the interior of the tower element.

The decoupling of the crane and the building with regard to torsional moments of the crane also is advantageous and subject-matter of the present invention, independent of the previously described use of an attachment point arranged at the tower element.

The present invention comprises a tower crane with a tower of at least one tower element, in particular lattice piece, a boom rotatably arranged at the tower, and a structural guying with at least one guying arrangement for the horizontal anchorage of the tower at a structure. It is provided that the guying arrangement allows a torsional movement of the tower with respect to the building. As a result, torsional moments no longer are transmitted to the building.

Advantageously, the connection between the guying arrangement and the tower allows a rotary movement of the tower about a vertical axis.

In a particularly preferred aspect of the present invention the tower crane is designed such as has been described above with regard to the first aspect of the present invention. In particular, the guying arrangement comprises a guy rod which is attached, in particular pivotally attached, to an attachment point of the tower element.

Alternatively, the guying arrangement might also be shiftably guided on an attachment curve which is connected with the tower element.

As an alternative to an arrangement with only one attachment point and two guy rods, at least two attachment points can also be provided at the tower element. In particular, the same can be arranged on a side face of the tower element.

It can be provided that on at least one of these attachment points at least two guy rods are attachable such that they extend to different attachment points with the structure. Furthermore, at least one guy rod can be attachable to the other attachment point such that it extends to one of the two attachment points with the structure or to a third attachment point with the structure. This also provides a stable guying. Advantageously, exactly three guy rods are used with this type of guying.

In particular, the attachment points arranged on a side face of the tower element can be arranged on a transverse strut of a tower element designed as lattice piece. In particular, these attachment points can be bolting points.

Advantageously, the height of the tower crane according to the invention can be increased by incorporating further tower elements during the erection of a structure, in order adapt the crane to the growing height of the structure.

Advantageously, the crane is a climbing crane, i.e. a crane which includes a device for inserting further tower elements, so that the tower crane does not have to be dismantled and erected again for this purpose.

The tower of a tower crane according to the invention advantageously consists of a plurality of tower elements connected with each other in vertical direction, as has already been described above. Advantageously, at least one tower element is anchored to a structure via its at least one attachment point. Advantageously, the tower crane is anchored to the structure such as has already been described above. Advantageously, the tower crane includes a plurality of tower elements, which each include attachment points via which they are anchored to the structure as described above.

Furthermore, the tower can include at least one tower element not connected with the structure. In particular, tower elements which are supported in horizontal direction also can alternate with tower elements which are not supported. For a non-supported tower element in particular a tower element can be used, which has no attachment points for a horizontal support. The tower of a tower crane according to the invention hence can be constructed of conventional tower elements and tower elements according to the invention.

The present invention furthermore comprises a tower element, in particular a lattice piece, for a tower crane as it has been described above. In particular, the tower element includes an attachment point to which at least one guy rod of a structural guying is directly attachable. Advantageously, the tower element is constructed such as it has been described above.

The present invention furthermore comprises a structure, in particular a wind turbine, comprising a tower crane as it has been described above. Via at least one guy rod, which extends from an attachment point of a tower element to an attachment point at the structure, the tower crane is anchored to the same. In particular, the horizontal anchorage of the tower of the tower crane is designed such as has already been described above.

The present invention furthermore comprises the use of a tower crane as it has been described above for the erection of a structure. In particular the use of the tower crane according to the invention relates to the erection of a wind turbine.

The tower crane according to the invention is a top-slewing crane, i.e. a crane in which the rotatable boom can be rotated by a stewing gear at the upper end of the tower. In particular, the tower crane is a trolley crane or a needle boom crane.

Figure 2:
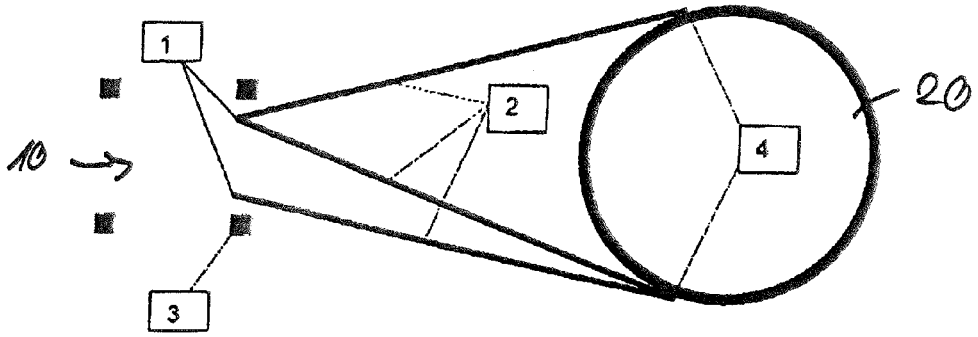
Figure 3:
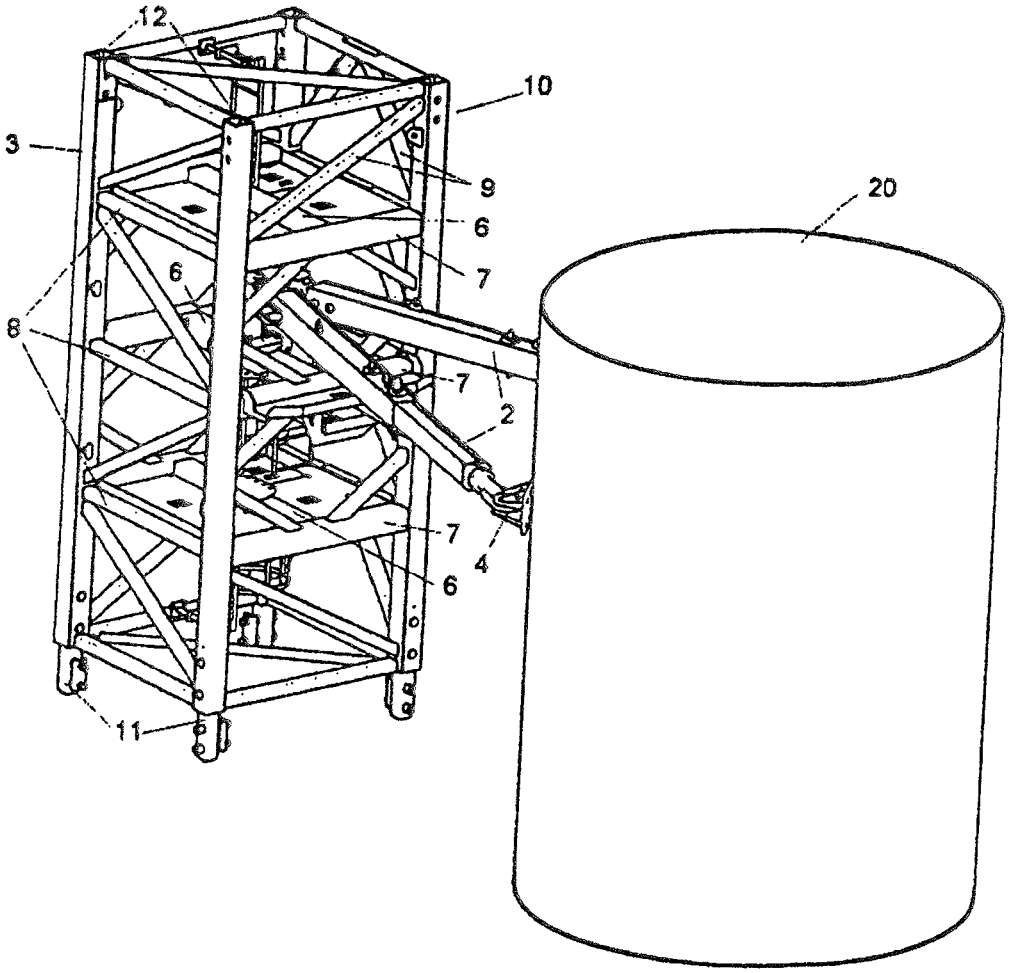
Figure 4:
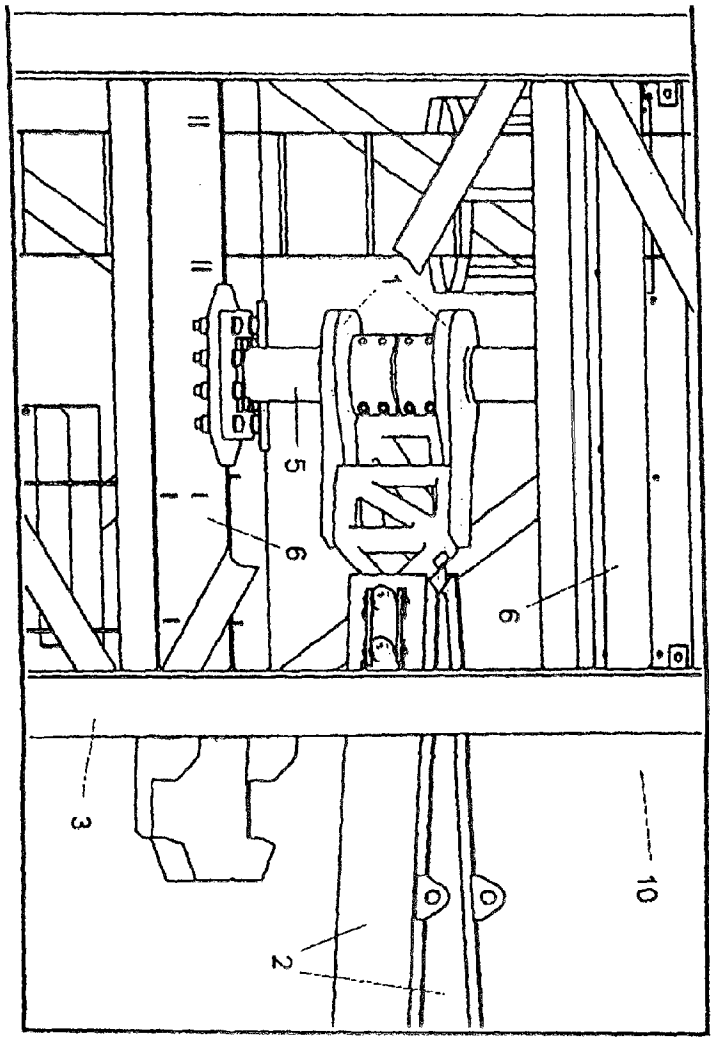
Figure 5:
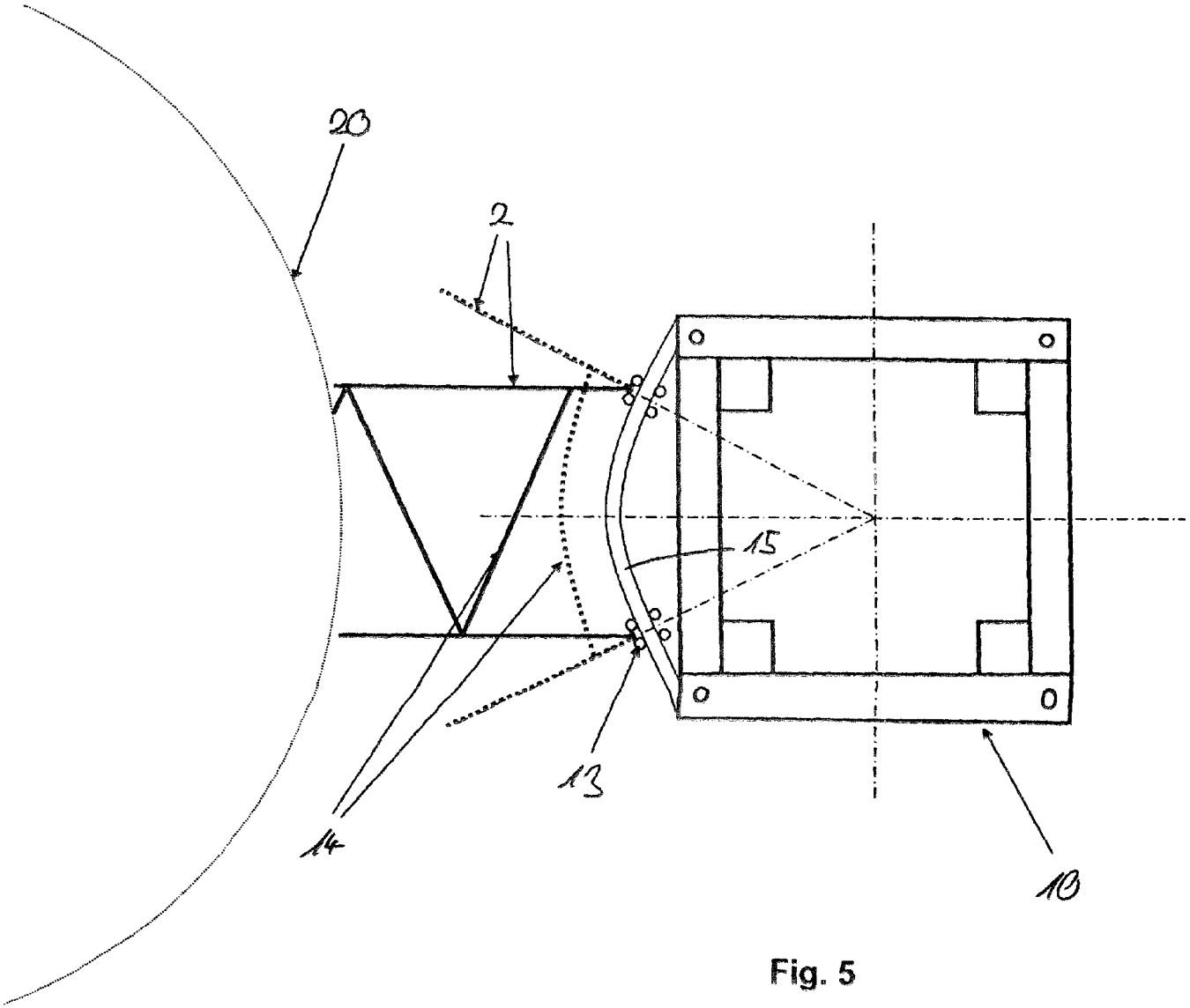

The present invention will now be explained in detail with reference to exemplary embodiments and drawings, in which:

FIG. 1: shows a schematic representation of a first exemplary embodiment of the present invention in a horizontal sectional view, FIG. 2: shows a schematic representation of a second exemplary embodiment of a tower crane according to the invention in a horizontal sectional view, FIG. 3: shows a third exemplary embodiment of a tower crane according to the invention in a perspective view, FIG. 4: shows the exemplary embodiment shown in FIG. 3 in a perspective side view, and FIG. 5: shows a schematic representation of a further exemplary embodiment of the present invention in a horizontal sectional view.

FIG. 1 shows a schematic representation of a first exemplary embodiment of a tower crane according to the invention in a horizontal sectional view. The tower element 10 of the tower crane, via which the horizontal anchorage of the tower at a structure 20 is effected, is shown symbolically with four corner posts 3, which corresponds to the preferred design of the tower element as lattice piece.

The tower element 10 is connected with the structure 20 via two guy rods 2, wherein here as well the typical shape of a mast of a wind turbine is shown symbolically for the structure 20. The guy rods 2 extend directly from an attachment point 1 of the tower element 10 to attachment points 4 at the structure.

In the exemplary embodiment shown in FIG. 1 the attachment point 1 is arranged in the interior of the tower element and in particular arranged centrally in width direction with respect to the side facing the structure. Particularly advantageously, the attachment point also is arranged centrally with respect to the base area of the tower element, i.e. at the same distance to the four corner posts 3. Due to the symmetrical or central arrangement of the attachment point, only two guy rods 2 to the structure are necessary. This means a reduction of the guy rods as compared to the prior art. The assembly effort thereby can further be minimized.

What is furthermore advantageous in this construction is the fact that the swivel moments transmitted to the structure are reduced. Advantageously, the guy rods are pivotally attached to the attachment point of the tower element about a vertical axis. As a result no more swivel moments of the crane at all are transmitted to the guying. The lower load on the building at the guying point according to the invention hence likewise can lead to a saving of costs on the part of the building.

FIG. 2 shows an alternative arrangement of the guying points at the tower element. There are provided two guying points which can be arranged for example on the side of the tower element facing the building. In this variant, at least three guy rods 2 are used, wherein from the first attachment point with the tower element two guy rods extend to different attachment points 4 at the structure 20. From the second attachment point 1 at the tower element a further guy rod 2 then extends to one of the two already used attachment points 4 with the structure 20. This results in two force triangles, whereby the tower element also is fixed at the structure with regard to swivel movements.

In FIGS. 3 and 4 a third exemplary embodiment of the present invention is shown, which with regard to the arrangement of the attachment points and guy rods corresponds to the first exemplary embodiment. FIG. 3 shows the tower element designed as lattice piece with the attachment point for the direct attachment of at least one guy rod. The lattice piece includes four corner posts 3 which are connected with each other in horizontal direction via transverse struts 7 and 8. Furthermore, diagonal struts 9 are provided to increase the stability. The end regions of the corner posts 3 include connecting elements 11 and 12 for connection with further tower elements. The connecting elements 11 can be inserted into connecting receptacles at a tower element disposed thereunder and be bolted there. In the same way, connecting elements of a further tower element can be inserted on the other side of the tower element and be bolted there.

The attachment point with the guy rods now is provided via a longitudinal strut 5 extending in vertical direction, i.e. parallel to the corner posts. The same is arranged centrally with respect to the base area of the tower element formed by the corner posts. The longitudinal strut 5 extends between two transverse struts 6 which in turn are attached to transverse struts 7 arranged between the corner posts. In particular, this construction can be a welded construction according to the invention.

The two guy rods 2 are attached to the longitudinal strut 5, so that the longitudinal strut provides an attachment point 1. In the exemplary embodiment two guy rods 2 are provided, as shown already in FIG. 1. The guy rods 2 are rotatably connected with the longitudinal strut 5, so that swivel moments of the tower element are not transmitted to the guy rods 2.

In their connecting region with the strut 5, the guy rods 2 include two horizontally extending tabs spaced from each other in vertical direction, which enclose the strut 5.

The guy rods 2 have a multipart design, so that an element forming the joint is firmly arranged at the attachment point 1 and a second element making the connection to the structure is releasably connectable with the same. The connection of the two elements is effected in the interior of the tower element.

As an alternative to the arrangement shown in FIG. 3 a direct bolting of the guy rods 2 with an attachment point of the tower element designed as bolt receptacle also would be conceivable.

The attachment points of the guy rods with the structure 20 advantageously are designed as boltings.

FIG. 5 now shows an exemplary embodiment of a further aspect of the present invention. The tower element 10 is connected with the structure 20 via a guying arrangement 30 such that no torsional forces are transmitted from the tower to the structure. For this purpose, the guying arrangement 30 includes guide elements 13 with which it is shiftably mounted on a guide curve 15. The guide curve 15 is shaped such that the tower can rotate about its center. As guide elements, castors are provided in this exemplary embodiment.

Beside guy rods 2 the guying arrangement furthermore includes a stiffening arrangement 14 by which the guy rods are connected with each other.

In the exemplary embodiment, the guide curve 15 is formed as separate element which is mountable on a side face of the tower element 10 and protrudes from the same. Other than according to the first aspect of the present invention, the connection in this exemplary embodiment therefore is not made directly with an attachment point of the tower element.

As an alternative to the arrangement shown in FIG. 5 it would likewise be conceivable to guide an annular guide curve around the entire tower element.

The tower element according to the invention in particular is used in tower cranes which grow with the structure to be erected, in that further tower elements are inserted. The support via the structural guying according to the invention for example can then be effected at regular intervals by using a correspondingly equipped tower element. Between tower elements according to the invention there can of course also be used tower elements without corresponding attachment points, when the support need not be effected at each tower element.

The tower cranes according to the invention particularly advantageously can be used especially during the assembly of wind turbines, as in the same the reduction of the assembly time for the crane or the horizontal structural guying as a whole, which is achieved according to the invention, leads to a distinct reduction of the assembly time for the wind turbine and hence to a considerable cost reduction.

Of course, however, the tower crane according to the invention can also be used during the erection of usual buildings.

The invention claimed is:

1. A tower crane comprising:

a tower including at least one tower element forming a lattice piece, and a structural guying with at least one guy rod for horizontal anchorage of the tower at a structure, wherein the at least one guy rod of the structural guying is attached or attachable to an attachment point of the at least one tower element, and the attachment point is provided by a strut extending in a vertical direction, which is arranged in the interior of the lattice piece.

2. The tower crane according to claim 1, wherein the at least one guy rod is one of at least two guy rods attachable to a common attachment point and extending to different attachment points with the structure.

3. The tower crane according to claim 1, wherein the attachment point is arranged centrally with respect to a side width or a base area of the at least one tower element.

4. The tower crane according to claim 1, wherein the strut extending in the vertical direction is arranged between two struts extending in a horizontal direction, which in turn connect with corner posts of the lattice piece by horizontal struts.

5. The tower crane according to claim 1, wherein the attachment point is one of at least two attachment points arranged on a side face of the at least one tower element, and wherein, to the one of the at least two attachment points, at least two guy rods are attachable such that they extend to different attachment points with the structure, and, to another of the at least two attachment points, at least one guy rod is attachable such that it extends to either of the at least two attachment points or to a third attachment point with the structure.

6. The tower crane according to claim 1, wherein the at least one guy rod is pivotally attached or attachable to the attachment point about a vertical axis.

7. The tower crane according to claim 1, further comprising a boom rotatably arranged on the tower, wherein the structural guying allows a torsional movement of the tower with respect to the structure so that the connection between the structural guying and the tower allows a rotary movement of the tower about a vertical axis.

8. The tower crane according to claim 1, wherein a height of the tower can be increased by incorporation of further tower elements during erection of the structure, in order to adapt the crane to the growing height of the structure, and wherein the crane is a climbing crane.

9. The tower crane according to claim 8, wherein the tower includes at least one tower element not connected with the structure, which has no attachment points.

10. The tower crane according to claim 1, wherein the tower includes a plurality of tower elements forming lattice pieces connected with each other in a vertical direction, and wherein at least one of the tower elements is anchored to the structure via its attachment point.

11. A wind turbine comprising a tower crane according to claim 1, wherein the tower crane is anchored to the wind turbine via the at least one guy rod, which extends from the attachment point of the tower element to an attachment point at the wind turbine.

12. Use of the tower crane according to claim 1 for erection of a wind turbine.

13. The tower crane according to claim 1, wherein the tower includes a plurality of tower elements forming lattice pieces connected with each other in a vertical direction, and wherein a plurality of tower elements are anchored to the structure via respective attachment points.

* * * * *